US008326167B2

(12) United States Patent
Fujiwara

(10) Patent No.: US 8,326,167 B2
(45) Date of Patent: Dec. 4, 2012

(54) FIXING DEVICE AND IMAGE FORMING APPARATUS CAPABLE OF IMPROVING FIXING EFFICIENCY AND SUPPRESSING OVERHEATING

(75) Inventor: Hidehiko Fujiwara, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 621 days.

(21) Appl. No.: 12/498,688

(22) Filed: Jul. 7, 2009

(65) Prior Publication Data

US 2010/0008691 A1 Jan. 14, 2010

(30) Foreign Application Priority Data

Jul. 14, 2008 (JP) ..... 2008-182708

(51) Int. Cl.
*G03G 15/20* (2006.01)

(52) U.S. Cl. ..... 399/69

(58) Field of Classification Search ..... 399/69, 399/33

See application file for complete search history.

(56) References Cited

U.S. PATENT DOCUMENTS

| | | | | |
|---|---|---|---|---|
| 5,058,877 | A | 10/1991 | Fujiwara et al. | |
| 6,151,466 | A | 11/2000 | Fujiwara | |
| 6,542,712 | B2 | 4/2003 | Kiuchi et al. | |
| 6,658,222 | B2 | 12/2003 | Kamijo et al. | |
| 6,731,900 | B2 | 5/2004 | Takenaka et al. | |
| 6,731,902 | B2 | 5/2004 | Takenaka et al. | |
| 6,788,916 | B2 | 9/2004 | Takenaka et al. | |
| 6,801,744 | B2 | 10/2004 | Fujiwara et al. | |
| 6,907,218 | B2 | 6/2005 | Fujiwara et al. | |
| 7,421,219 | B2 * | 9/2008 | Matsuura et al. | 399/45 |
| 2008/0304866 | A1 | 12/2008 | Takenaka et al. | |
| 2009/0010688 | A1 | 1/2009 | Takahashi et al. | |
| 2009/0116884 | A1 | 5/2009 | Nonaka et al. | |
| 2009/0148207 | A1 | 6/2009 | Yamada et al. | |

FOREIGN PATENT DOCUMENTS

| | | | |
|---|---|---|---|
| JP | 58-190659 | | 12/1983 |
| JP | 6-282185 | | 10/1994 |
| JP | 06282185 A | * | 10/1994 |
| JP | 8-27571 | | 3/1996 |
| JP | 2545135 | | 7/1996 |

OTHER PUBLICATIONS

Machine translation of JP06-282185.*
U.S. Appl. No. 12/379,233, filed Feb. 17, 2009, Unknown.

* cited by examiner

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

In a fixing device, a rotatable endless film heats a sheet. A heat source is contacted and surrounded by the endless film to heat the endless film. A pressing member is disposed opposite the heat source. An air current generator generates an air current inside a loop formed by the endless film. The endless film and the pressing member are disposed to sandwich and feed the sheet forward as the sheet passes therebetween. The air current generator concentrates the air current on the endless film to heat the sheet at a given position.

16 Claims, 5 Drawing Sheets

FIXING DEVICE AND IMAGE FORMING APPARATUS CAPABLE OF IMPROVING FIXING EFFICIENCY AND SUPPRESSING OVERHEATING

CROSS-REFERENCE TO RELATED APPLICATION

The present application is based on and claims priority to Japanese Patent Application No. 2008-182708, filed on Jul. 14, 2008 in the Japan Patent Office, the entire contents of which are hereby incorporated herein by reference.

BACKGROUND OF THE INVENTION

1. Field of the Invention

Exemplary aspects of the present invention relate to a fixing device and an image forming apparatus, and more particularly, to a fixing device and an image forming apparatus including the fixing device for fixing a toner image on a recording medium.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data using electrophotography. Thus, for example, a charger uniformly charges a surface of an image carrier; an optical writer emits a light beam onto the charged surface of the image carrier to form an electrostatic latent image on the image carrier according to the image data; a development device supplies toner particles to the electrostatic latent image formed on the image carrier to make the electrostatic latent image visible as a toner image; the toner image is directly transferred from the image carrier onto a sheet or is indirectly transferred from the image carrier onto a sheet via an intermediate transfer member; a cleaner then cleans the surface of the image carrier after the toner image is transferred from the image carrier onto the sheet; finally, a fixing device applies heat and pressure to the sheet bearing the toner image to fix the toner image on the sheet, thus forming the image on the sheet.

In one example of a fixing device included in such image forming apparatuses, a belt is looped over a fixing roller and a tension roller. A pressing roller presses against the fixing roller via the belt to form a fixing nip portion between the pressing roller and the belt, where a sheet is passed by the belt between the pressing roller and the fixing roller. A heat source heats an outer circumferential surface of the belt. When a sheet bearing a toner image passes through the fixing nip portion, the heated belt and the pressing roller apply heat and pressure to the sheet to fix the toner image on the sheet.

Such a fixing device is designed so that a certain amount of heat is absorbed from the belt by the sheets as the belt passes the sheets between the fixing roller and the pressing roller. However, this design generally assumes that the sheets span the entire width of the belt. Consequently, when small size sheets, that is, sheets that are not wide enough to span the entire width of the belt, pass through the fixing nip portion continuously, a non-contact region on the belt not contacted by the sheets may get overheated.

To address this problem, another example of a fixing device includes an air intake member provided near the outer circumferential surface of the belt to cool the belt. However, the air intake member generates an air current on or above the outer circumferential surface of the belt, and accordingly, may generate a turbulent air flow near the fixing nip portion when a sheet bearing a toner image passes through the fixing nip portion that can disrupt the toner image on the sheet.

To address this problem, yet another example of a fixing device includes a fan provided inside a loop formed by the belt to generate an air current inside the loop formed by the belt.

However, the air current generated by the fan near the belt may cool the belt to such an extent that it takes additional time and energy to heat the belt up to a proper fixing temperature, resulting in degraded thermal efficiency.

BRIEF SUMMARY OF THE INVENTION

This specification describes below a fixing device according to an exemplary embodiment of the present invention. In one exemplary embodiment of the present invention, the fixing device includes a rotatable endless film, a heat source, a pressing member, and an air current generator. The endless film heats a sheet. The heat source is contacted and surrounded by the endless film to heat the endless film. The pressing member is disposed opposite the heat source. The air current generator generates an air current inside a loop formed by the endless film. The endless film and the pressing member are disposed to sandwich and feed the sheet forward as the sheet passes therebetween. The air current generator concentrates the air current on the endless film to heat the sheet at a given position.

This specification further describes below an image forming apparatus according to an exemplary embodiment of the present invention. In one exemplary embodiment of the present invention, the image forming apparatus includes a fixing device to fix a toner image on a sheet. The fixing device includes a rotatable endless film, a heat source, a pressing member, and an air current generator. The endless film heats the sheet. The heat source is contacted and surrounded by the endless film to heat the endless film. The pressing member is disposed opposite the heat source. The air current generator generates an air current inside a loop formed by the endless film. The endless film and the pressing member are disposed to sandwich and feed the sheet forward as the sheet passes therebetween. The air current generator concentrates the air current on the endless film to heat the sheet at a given position.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
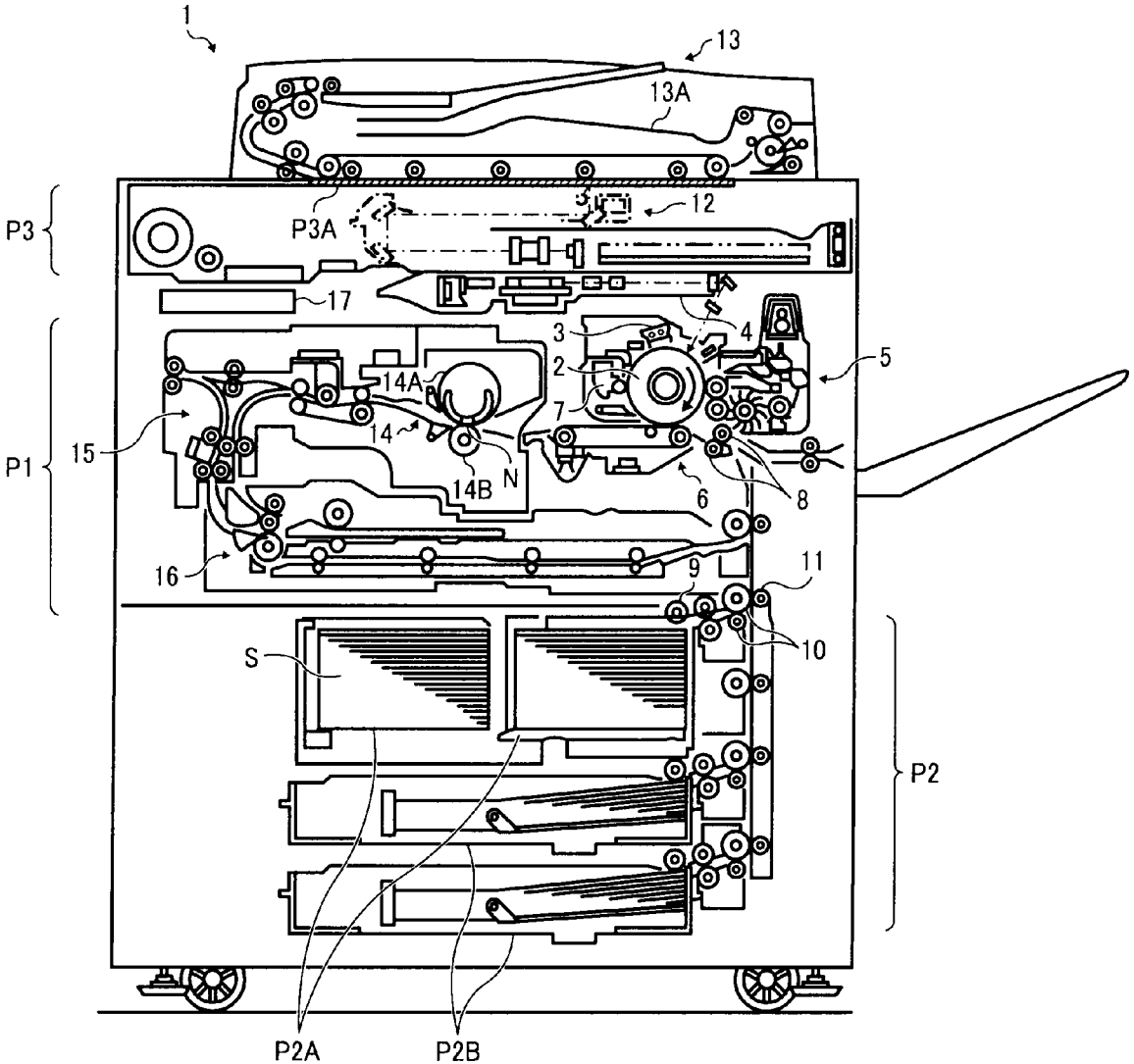
FIG. 1 is a sectional front view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a sectional front view of the image forming apparatus 1. The image forming apparatus 1 includes an image forming device P1, a sheet supplier P2, an original scanner P3, and a controller 17.

The image forming device P1 includes a photoconductive drum 2, a charger 3, a writer 4, a development device 5, a transfer device 6, a cleaner 7, a registration roller pair 8, a fixing device 14, a switch device 15, and a duplex device 16. The fixing device 14 includes a fixing film 14A and a pressing roller 14B.

The sheet supplier P2 includes paper trays P2A and P2B, a pickup roller 9, a separation roller pair 10, and a feeding roller 11.

The original scanner P3 includes an exposure glass P3A, an optical device 12, and an auto document feeder (ADF) 13. The ADF 13 includes an original output tray 13A.

The image forming apparatus 1 can be a copier, a facsimile machine, a printer, a plotter, a multifunction printer having at least one of copying, printing, scanning, plotter, and facsimile functions, or the like. According to this non-limiting exemplary embodiment of the present invention, the image forming apparatus 1 functions as a copier for forming an image on a recording medium by electrophotography.

The image forming device P1 is provided in a center portion of the image forming apparatus 1 in a vertical direction. The sheet supplier P2 is provided under the image forming device P1. The original scanner P3 is provided above the image forming device P1. The controller 17 controls operations of the image forming apparatus 1.

In the image forming device P1, the charger 3, the writer 4, the development device 5, the transfer device 6, and the cleaner 7 surround the photoconductive drum 2. The photoconductive drum 2, that is, a photoconductor having a drum shape, serves as a latent image carrier and rotates clockwise in FIG. 1. The charger 3, the writer 4, the development device 5, the transfer device 6, and the cleaner 7 are arranged around the photoconductive drum 2 in this order in a direction of rotation of the photoconductive drum 2 so as to perform image forming processes sequentially.

According to this exemplary embodiment, the writer 4 provides a single optical path for forming a latent image corresponding to a single color. Alternatively, the writer 4 may provide two or more optical paths for forming latent images corresponding to different colors, respectively, for example.

In the sheet supplier P2, the paper trays P2A and P2B load transfer sheets S. For example, the paper trays P2A and P2B may load transfer sheets S having different sizes, respectively. The pickup roller 9 is provided near an exit of each of the paper trays P2A and P2B through which a transfer sheet S is sent toward the image forming device P1. The pickup roller 9 rotates to pick up transfer sheets S from each of the paper trays P2A and P2B and sends the transfer sheets S toward the separation roller pair 10. One roller of the separation roller pair 10 rotates forward and another roller of the separation roller pair 10 rotates backward to send the transfer sheets S one by one toward the feeding roller 11. For example, the separation roller pair 10 separates an uppermost transfer sheet S from other transfer sheets S by using friction between the transfer sheet S and the separation roller pair 10 to send the uppermost transfer sheet S toward the feeding roller 11. The feeding roller 11 sends the transfer sheet S sent by the separation roller pair 10 toward the registration roller pair 8 of the image forming device P1. FIG. 1 does not illustrate the pickup roller 9, the separation roller pair 10, and the feeding roller 11 provided near the exit of the left paper tray P2A.

In the original scanner P3, the optical device 12 scans an image on an original document sheet placed on the exposure glass P3A to generate image data. The image data is sent to the writer 4 of the image forming device P1. The optical device 12 includes a light source, a moving carriage mounted with a mirror and a lens, and a photoelectric transducer. The light source emits light onto the original document sheet placed on the exposure glass P3A. The mirror and the lens mounted on the moving carriage gather light reflected by the original document sheet. The photoelectric transducer receives the light gathered by the mirror and the lens.

The ADF 13 has a known structure used for the image forming apparatus 1. For example, the ADF 13 includes an original input tray, feeding rollers, and discharging rollers in addition to the original output tray 13A. The feeding rollers feed an original document sheet placed on the original input tray toward the exposure glass P3A. After the optical device 12 scans an image on the original document sheet, the discharging rollers feed the original document sheet from the exposure glass P3A toward the original output tray 13A.

The ADF 13 further includes a mechanism for reversing the original document sheet so that the optical device 12 scans another side of the original document sheet.

With the above-described structure, the charger 3 charges a surface of the photoconductive drum 2. The writer 4 emits light onto the charged surface of the photoconductive drum 2 according to the image data sent from the optical device 12 so as to form a latent image on the surface of the photoconductive drum 2. The development device 5 supplies toner to the latent image formed on the photoconductive drum 2 to make the latent image visible as a toner image.

The registration roller pair 8 is provided upstream from the transfer device 6 in a conveyance direction of the transfer sheet S, and feeds the transfer sheet S fed by the feeding roller 11 toward the transfer device 6.

The transfer device 6 transfers the toner image formed on the surface of the photoconductive drum 2 onto the transfer sheet S fed by the registration roller pair 8. The cleaner 7 cleans the surface of the photoconductive drum 2 after the toner image is transferred from the photoconductive drum 2 onto the transfer sheet S. The transfer device 6 includes a transfer belt for attracting and conveying the transfer sheet S. Thus, the toner image is transferred from the photoconductive drum 2 onto the transfer sheet S conveyed by the transfer belt. After passing through the transfer device 6, the transfer sheet S enters the fixing device 14. The fixing device 14 fixes the toner image on the transfer sheet S.

In the fixing device 14, the fixing film 14A serves as an endless film surrounding a heat source. The rotatable pressing roller 14B, serving as a pressing member, opposes and contacts the fixing film 14A to form a fixing nip portion N at which the fixing film 14A and the pressing roller 14B apply heat and pressure to the transfer sheet S bearing the toner image to fix the toner image on the transfer sheet S. Specifically, a circumferential surface of the pressing roller 14B opposes and contacts a circumferential surface of the fixing film 14A to form the fixing nip portion N at which the fixing film 14A and the pressing roller 14B apply heat and pressure to the transfer sheet S bearing the toner image while the fixing film 14A and the pressing roller 14B nip and convey the transfer sheet S.

After passing through the fixing device 14, the transfer sheet S moves on a conveyance path for sending the transfer sheet S toward an output tray. The switch device 15 is provided in the conveyance path, and switches a conveyance direction of the transfer sheet S bearing the fixed toner image between a direction for sending the transfer sheet S toward the output tray and a direction for sending the transfer sheet S toward the duplex device 16. The duplex device 16 reverses and sends the transfer sheet S, which bears the toner image on a front side thereof, toward the photoconductive drum 2 so that a toner image is transferred from the photoconductive drum 2 onto a back side of the transfer sheet S.

In the image forming apparatus 1, a toner image obtained by visualizing a latent image (e.g., an electrostatic latent image) formed on the photoconductive drum 2 is transferred from the photoconductive drum 2 onto a transfer sheet S, such as a sheet or an OHP (overhead projector) transparency, serving as a recording medium. Thereafter, the toner image is fixed on the transfer sheet S. Alternatively, an electrostatic latent image may be transferred onto a recording medium having a sheet shape, for example, a transfer sheet, and then visualized as a toner image. Thereafter, the toner image may be fixed on the transfer sheet.

A toner image may be transferred from a latent image carrier (e.g., the photoconductive drum 2) onto a recording medium either by a direct transfer method or an indirect transfer method. In the direct transfer method, the toner image is transferred from the latent image carrier onto the recording medium directly. In the indirect transfer method, the toner image is transferred from the latent image carrier onto the recording medium indirectly via an intermediate transfer member (e.g., an intermediate transfer belt).

Figure 2:
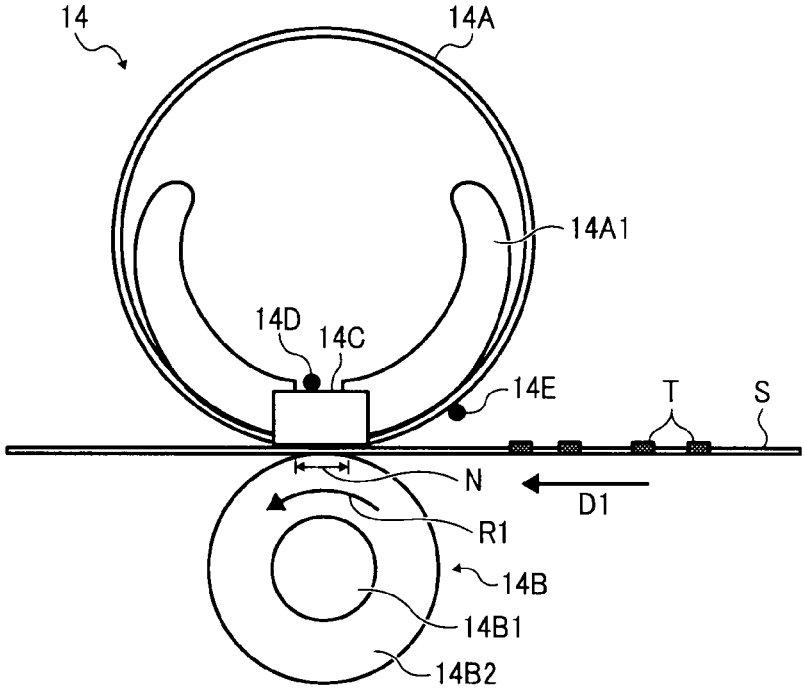
FIG. 2 is a sectional front view of a fixing device included in the image forming apparatus shown in FIG. 1.

FIG. 2 is a sectional front view of the fixing device 14. The fixing device 14 further includes a heat source 14C and temperature sensors 14D and 14E. The fixing film 14A includes a guide stay 14A1. The pressing roller 14B includes a shaft 14B1 and an elastic layer 14B2.

Figure 3:
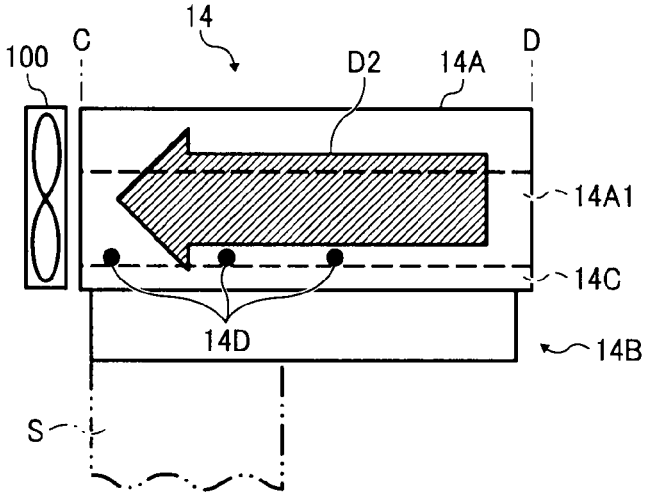
FIG. 3 is a sectional side view of the fixing device shown in FIG. 2.

FIG. 3 is a sectional side view of the fixing device 14. The fixing device 14 further includes a fan 100.

As illustrated in FIG. 2, the fixing film 14A is an endless film having a single layer or a plurality of layers and having a total thickness not greater than about 100 μm. The fixing film 14A has a loop-like shape and provides heat-resistance and proper releasing property for releasing toner particles contained in a toner image T on a transfer sheet S. The guide stay 14A1 is provided inside the fixing film 14A, and causes the fixing film 14A to contact the pressing roller 14B.

The pressing roller 14B opposes and contacts the fixing film 14A to nip (e.g., sandwich) and feed (e.g., convey) the transfer sheet S sent to the fixing nip portion N. Therefore, in the pressing roller 14B, the elastic layer 14B2 including rubber and/or the like is provided on an outer circumferential surface of the shaft 14B1. The pressing roller 14B presses against the heat source 14C via the fixing film 14A to form the fixing nip portion N at which the pressing roller 14B and the fixing film 14A nip the transfer sheet S serving as a heated member.

A motor drives and rotates the shaft 14B1 of the pressing roller 14B to rotate the pressing roller 14B counterclockwise in FIG. 2 in a direction R1. Accordingly, the pressing roller 14B feeds the transfer sheet S bearing the toner image T leftward in FIG. 2 in a direction D1 while the pressing roller 14B and the fixing film 14A nip the transfer sheet S.

The heat source 14C is mounted inside the guide stay 14A1. An electric resistive element, serving as a heat generating source, is provided on a substrate including ceramic and having a high thermal conductivity. The temperature sensors 14D, serving as temperature detectors, are provided on the heat source 14C to perform temperature control. Similarly, the temperature sensors 14E, serving as temperature detectors, are provided on an outer circumferential surface of the fixing film 14A to perform temperature control. As illustrated in FIG. 3, the temperature sensors 14D are provided inside and outside a sheet conveyance region on the fixing film 14A in which the transfer sheet S is conveyed and along a channel of an air current flown inside the fixing film 14A in a longitudinal direction of the fixing film 14A. Similarly, the temperature sensors 14E are provided inside and outside the sheet conveyance region in the longitudinal direction of the fixing film 14A.

The heat source 14C contacts one surface of the fixing film 14A. The temperature sensors 14D are provided on the heat source 14C to perform temperature control to prevent overheating.

The rotating pressing roller 14B rotates the fixing film 14A. Accordingly, the pressing roller 14B feeds the transfer sheet S while the pressing roller 14B presses the transfer sheet S against the fixing film 14A at the fixing nip portion N so that the pressing roller 14B and the fixing film 14A nip the transfer sheet S.

According to this exemplary embodiment, an air current generates inside a loop (e.g., a rotation region) formed by the fixing film 14A, and the fixing film 14A heats the transfer sheet S serving as a heated member at a heat concentration position at which heat is concentrated in a flow direction of the air current.

As illustrated in FIG. 3, the fan 100, serving as an air current generator, is provided near the fixing film 14A at a position on the left of one end of the fixing film 14A in FIG. 3 in a width direction of the fixing film 14A. The width direction of the fixing film 14A is perpendicular to the direction of rotation of the fixing film 14A and is parallel to an axial direction of the pressing roller 14B.

When the fan 100 is provided on the left of one end of the fixing film 14A in the width direction of the fixing film 14A, an air current flows in a direction D2. The fan 100 may be an aspiration fan to flow the air current in the direction D2.

In FIG. 3, a position C corresponds to one end of the fixing film 14A in the width direction of the fixing film 14A, near which the fan 100 is provided. A position D corresponds to another end, which is opposite to the position C, of the fixing film 14A in the width direction of the fixing film 14A.

Figure 4:
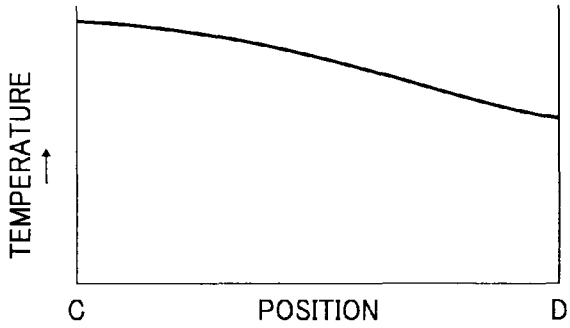
FIG. 4 is a diagram illustrating a temperature distribution of a fixing film included in the fixing device shown in FIG. 3 in a width direction of the fixing film.

FIG. 4 is a diagram illustrating a temperature distribution of the fixing film 14A in the width direction of the fixing film 14A when the fan 100 is provided as illustrated in FIG. 3. The position C corresponds to one end of the fixing film 14A in the width direction of the fixing film 14A, near which the fan 100 is provided, and the position D corresponds to another end, which is opposite to the position C, of the fixing film 14A in the width direction of the fixing film 14A, as illustrated in FIG. 3.

As illustrated in FIG. 4, temperature of the fixing film 14A increases at the position C near the fan 100 due to concentration of heat. By contrast, temperature of the fixing film 14A decreases at the position D near which the fan 100 is not provided. Namely, the fan 100 moves heat generated at the position D toward the position C.

As illustrated in FIG. 3, according to this exemplary embodiment, the fixing film 14A heats a transfer sheet S at the position C, that is, the heat concentration position at which heat is concentrated. Accordingly, the transfer sheet S moves on the fixing film 14A in a state in which one side of the transfer sheet S is aligned at the position C. In other words, temperature of the fixing film 14A increases substantially at the position C through which the transfer sheet S passes. By contrast, temperature of the fixing film 14A does not increase at the position D opposite to the position C in the width direction of the fixing film 14A. Consequently, the fixing film 14A provides a proper temperature for fixing a toner image T on the transfer sheet S at the position C at which the fixing film 14A heats the transfer sheet S. Overheating of the fixing film 14A can be suppressed at a position other than the position C, preventing or reducing wear of the fixing film 14A caused by overheating.

Figure 5:
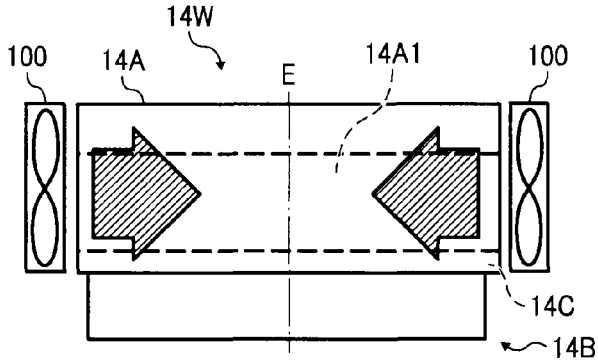
FIG. 5 is a sectional side view of a fixing device according to another exemplary embodiment of the present invention.

FIG. 5 is a sectional side view of a fixing device 14W according to another exemplary embodiment. The fixing device 14W includes another fan 100 in addition to the fan 100 depicted in FIG. 3. The other elements of the fixing device 14W are equivalent to the elements of the fixing device 14 depicted in FIG. 3.

In the fixing device 14W, the fans 100 are provided near both ends of the fixing film 14A in the width direction of the fixing film 14A. The fans 100 send air to a position E, that is, a center of the fixing film 14A in the width direction of the fixing film 14A to concentrate air at a heat concentration position at the center of the fixing film 14A.

Accordingly, a transfer sheet S moves on the fixing film 14A in such a manner that a center of the transfer sheet S in a width direction of the transfer sheet S corresponds to the center of the fixing film 14A in the width direction of the fixing film 14A. In other words, temperature of the fixing film 14A increases substantially at the position E through which the transfer sheet S passes due to an air current concentrated at the position E. By contrast, temperature of the fixing film 14A decreases at both ends of the fixing film 14A in the width direction of the fixing film 14A at which the air current does not concentrate and heat leaks.

With the above-described structure of the fixing device 14W, a small size transfer sheet S, which has a width shorter than the width of the fixing film 14A, moves on the fixing film 14A in such a manner that a center of the transfer sheet S in a width direction of the transfer sheet S corresponds to the position E, that is, the center of the fixing film 14A in the width direction of the fixing film 14A. Accordingly, the fixing film 14A transmits heat to the transfer sheet S effectively at the heat concentration position, that is, the center of the fixing film 14A in the width direction of the fixing film 14A. In other words, the fans 100 increase temperature of the fixing film 14A to correspond to the small size transfer sheet S. Thus, the fixing device 14W can provide improved fixing efficiency for the small size transfer sheet S. Further, the fixing device 14W can suppress temperature increase of the fixing film 14A at a region outside the sheet conveyance region on the fixing film 14A in which the transfer sheet S is conveyed, that is, an outside region of the fixing film 14A, on which the small size transfer sheet S does not move, preventing or reducing overheating of the fixing film 14A.

Alternatively, an amount of air sent by at least one fan 100 (e.g., the fan 100 depicted in FIG. 3 or the fans 100 depicted in FIG. 5), or a rotation speed of the at least one fan 100 may be changed according to a temperature of an air current detected by the temperature sensors 14D depicted in FIG. 3 or a surface temperature of the fixing film 14A detected by the temperature sensors 14E depicted in FIG. 2. For example, when the temperature of the air current or the surface temperature of the fixing film 14A does not reach a proper fixing temperature in the sheet conveyance region of the fixing film 14A, on which a transfer sheet S moves, or the fixing film 14A is overheated, the controller 17 depicted in FIG. 1 controls rotation of the at least one fan 100 to change an amount or speed of sending air so as to resolve such failures. Accordingly, temperature increase of the fixing film 14A at the heat concentration position can be maintained in a safe range not deteriorating durability of the fixing film 14A. Further, overheating can be suppressed in the outside region of the fixing film 14A in which a transfer sheet S does not move on the fixing film 14A.

Figure 6:
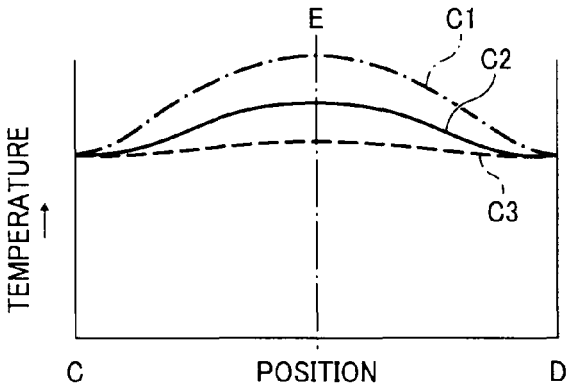
FIG. 6 is a diagram illustrating a temperature distribution of a fixing film included in the fixing device shown in FIG. 5 in a width direction of the fixing film.

FIG. 6 is a diagram illustrating a temperature distribution of the fixing film 14A of the fixing device 14W depicted in FIG. 5 in the width direction of the fixing film 14A. When a small size transfer sheet S having a width smaller than a valid width of the fixing film 14A in which a transfer sheet S is movable on the fixing film 14A moves on the fixing film 14A, the controller 17 depicted in FIG. 1 controls the fans 100 depicted in FIG. 5 to send air according to a curve C1 shown in FIG. 6 so that a large volume of air current generates at the position E, that is, the center of the fixing film 14A in the width direction of the fixing film 14A. Accordingly, a substantial amount of air is concentrated at the position E. Consequently, the fixing film 14A can supply a proper amount of heat to be used for fixing to the small size transfer sheet S. The controller 17 may control the fans 100 to send a large volume (e.g., a proper volume) of air to the position E even for a smaller size transfer sheet S.

Alternatively, the controller 17 may control the fans 100 to send air according to a curve C2 shown in FIG. 6 so that a medium volume of air current generates at the position E. Yet alternatively, the controller 17 may control the fans 100 to send air according to a curve C3 shown in FIG. 6 so that a small volume of air current generates at the position E.

Figure 7:
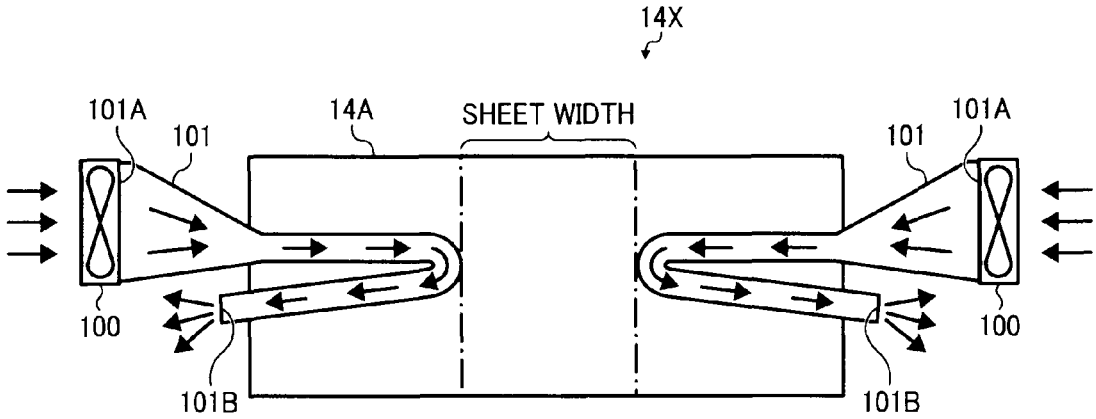
FIG. 7 is a sectional side view of a fixing device according to yet another exemplary embodiment of the present invention.

FIG. 7 is a sectional side view of a fixing device 14X according to yet another exemplary embodiment. The fixing device 14X includes air current guides 101. The air current guide 101 includes an air current inlet 101A and an air current outlet 101B. The other elements of the fixing device 14X are equivalent to the elements of the fixing device 14W depicted in FIG. 5.

The fixing device 14X prevents or reduces thermal degradation of the fixing film 14A due to overheating. The air current guides 101 are provided near both ends of the fixing film 14A in the width direction of the fixing film 14A perpendicular to a moving direction, that is, the direction of rotation, of the fixing film 14A. Each of the air current guides 101 circulates an air current sent from the fan 100 serving as an air current generator inside and outside of the fixing film 14A.

The air current guide 101 includes a duct extending from the fan 100 toward the center of the fixing film 14A in the width direction of the fixing film 14A and turning before the center of the fixing film 14A. In other words, the air current guide 101 extends from the fan 100 to the center of the fixing film 14A in the width direction of the fixing film 14A inside a loop formed by the fixing film 14A and is bent back toward the fan 100. Thus, the duct of the air current guide 101 serves as a heat exchange channel for discharging air from an end of the fixing film 14A in the width direction of the fixing film 14A to an outside of the fixing film 14A.

The air current guide 101 turns or is bent back toward the fan 100 at a position not entering a sheet width, that is, a sheet conveyance region of the fixing film 14A in which a transfer sheet S moves on the fixing film 14A, in the width direction of the fixing film 14A. In other words, the air current guide 101 turns at the position outside the sheet width of the transfer sheet S, that is, the sheet conveyance region of the fixing film 14A in which the transfer sheet S moves on the fixing film 14A. The air current inlet 101A of the air current guide 101 is connected to the fan 100. The air current outlet 101B of the air current guide 101 is provided near an end of the fixing film 14A in the width direction of the fixing film 14A. Thus, the air current guide 101 provides the thermal exchange channel for circulating air from the air current inlet 101A toward the air current outlet 101B so that air is discharged from the air current outlet 101B to an outside of the air current guide 101.

The air current guide 101 is provided outside the sheet conveyance region of the fixing film 14A in which the transfer sheet S moves on the fixing film 14A. Air used as a refrigerant moves inside the air current guide 101 in such a manner that air circulates inside and outside the fixing film 14A.

Accordingly, the thermal exchange channel provided outside the sheet conveyance region of the fixing film 14A in which the transfer sheet S moves on the fixing film 14A in the width direction of the fixing film 14A cools an inside of the fixing film 14A. Consequently, overheating of the fixing film 14A is suppressed in an outside region outside the sheet conveyance region of the fixing film 14A in which the transfer sheet S moves on the fixing film 14A.

Figure 8:
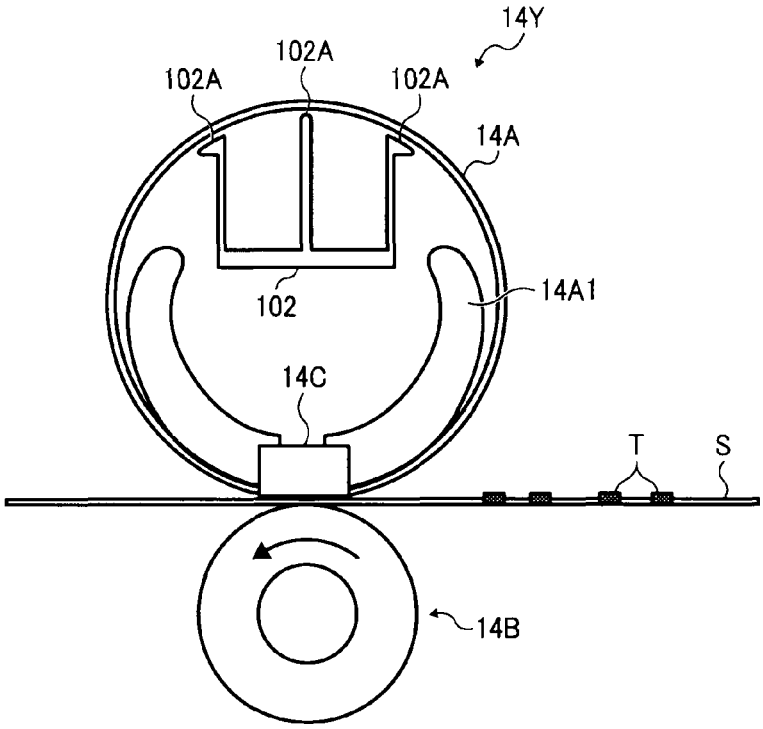
FIG. 8 is a sectional front view of a fixing device according to yet another exemplary embodiment of the present invention.

FIG. 8 is a sectional front view of a fixing device 14Y according to yet another exemplary embodiment. The fixing device 14Y includes an air current guide 102. The air current guide 102 includes guide members 102A. The other elements of the fixing device 14Y are equivalent to the elements of the fixing device 14 depicted in FIG. 2.

Like the guide stay 14A1, the air current guide 102 supports and guides the fixing film 14A. Specifically, the guide member 102A of the air current guide 102 includes an opposing surface for opposing an inner circumferential surface of the fixing film 14A and corresponding to a circumferential orbit of the fixing film 14A. Thus, the fixing film 14A slides on the opposing surfaces of the guide members 102A. In FIG. 8, the inner circumferential surface of the fixing film 14A separates from the guide members 102A to show the shape of the guide members 102A. However, the inner circumferential surface of the fixing film 14A contacts the guide members 102A actually.

Like in the fixing device 14X depicted in FIG. 7, an air current circulates inside the air current guide 102. Accordingly, unlike a known heat sink, circulation of an air current can provide forced cooling of the fixing film 14A. Thus, a single element, that is, the air current guide 102, can guide the moving fixing film 14A and cool an outside region of the fixing film 14A in which a transfer sheet S does not move on the fixing film 14A. Further, the fixing film 14A moves on the air current guide 102 in a state in which the fixing film 14A contacts the guide members 102A of the air current guide 102. Accordingly, air flowing inside the air current guide 102 does not leak to an inside of the fixing film 14A. Consequently, air, serving as a refrigerant, contacts the fixing film 14A properly to improve cooling efficiency.

Figure 9:
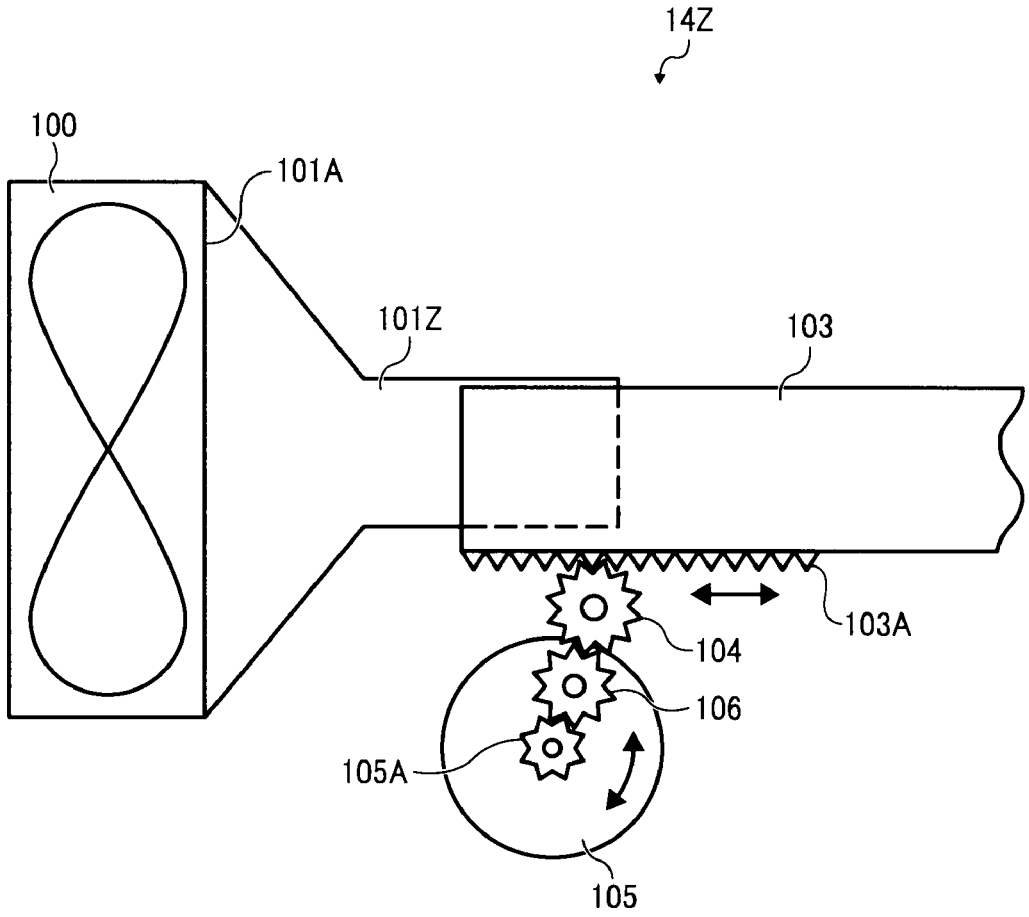
FIG. 9 is a sectional side view of a fixing device according to yet another exemplary embodiment of the present invention.

Referring to FIG. 9, the following describes a modified example of the air current guide 101 depicted in FIG. 7. FIG. 9 is a sectional side view of a fixing device 14Z according to yet another exemplary embodiment. The fixing device 14Z includes an air current guide 101Z, a slide duct 103, a rack 103A, a pinion 104, a motor 105, a driving gear 105A, and an idle gear 106.

In the fixing device 14Z, a turning position (e.g., a bent position) of the air current guide 101Z (e.g., an air current duct) is changeable to prevent temperature decrease of the fixing film 14A (depicted in FIG. 7) in the sheet conveyance region of the fixing film 14A in which a transfer sheet S moves on the fixing film 14A. For example, the turning position of the air current guide 101Z is changed according to the sheet width of the transfer sheet S. FIG. 9 illustrates a structure of the fixing device 14Z for changing the turning position of the air current guide 101Z.

The air current guide 101Z (e.g., an air current duct) extending from the air current inlet 101A connected to the fan 100 serving as an air current generator is cut before the turning position, and the slide duct 103 is connected to the air current guide 101Z.

The pinion 104 supported by a support engages the rack 103A provided on a part of the slide duct 103.

The pinion 104 also engages the idle gear 106 engaging the driving gear 105A provided on an output shaft of the motor 105. Thus, a moving direction and a moving amount of the pinion 104, which moves on the rack 103A, are adjusted according to a direction and an amount of rotation of the motor 105.

With the above-described structure of the fixing device 14Z, the controller 17 depicted in FIG. 1 controls rotation of the motor 105 to change the turning position of the slide duct 103 which is separately provided from the air current guide 101Z and is slidable on the air current guide 101Z. Namely, the turning position of the slide duct 103 can be changed in the width direction of the fixing film 14A according to the sheet conveyance region of the fixing film 14A in which a transfer sheet S moves on the fixing film 14A. Accordingly, the slide duct 103, which cools the fixing film 14A, does not enter the sheet conveyance region of the fixing film 14A. Consequently, the fixing device 14Z can prevent overheating of the fixing film 14A in the outside region of the fixing film 14A in which the transfer sheet S does not move on the fixing film 14A, while providing a proper amount of heat for fixing.

According to the above-described exemplary embodiments, in a fixing device (e.g., the fixing device 14 depicted in FIG. 3, the fixing device 14W depicted in FIG. 5, the fixing device 14X depicted in FIG. 7, the fixing device 14Y depicted in FIG. 8, or the fixing device 14Z depicted in FIG. 9), an air current generator (e.g., the fan 100 depicted in FIGS. 3, 5, 7, and 9) generates an air current inside a loop formed by an endless film (e.g., the fixing film 14A depicted in FIGS. 3, 5, 7, and 8) in an air current generation direction. The air current generator concentrates the air current on the endless film to heat a heated member (e.g., the transfer sheet S depicted in FIGS. 3 and 8) at a given position. In other words, the endless film heats the heated member at a heat concentration position in the air current generation direction, at which heat is concentrated by the air current generated by the air current generator.

Thus, the fixing device can heat the heated member effectively. The heat concentration position corresponds to an end or a center of the endless film in a width direction of the endless film, which is perpendicular to a moving direction of the endless film, according to the air current generation direction and a position of the air current generator. The heated member moves on the endless film at the heat concentration position to improve fixing efficiency. At a non-heating position other than the heat concentration position that is a heating position at which the endless film heats the heated member, the air current generated by the air current generator conveys heat. Accordingly, the non-heating position on the endless film is not overheated.

A controller (e.g., the controller 17 depicted in FIG. 1) controls supply of the air current according to an amount of air current at the heating position on the endless film, a temperature of the endless film, or a width of the heated member. Accordingly, improved heating efficiency can be maintained at the heating position on the endless film.

An air current guide (e.g., the air current guide 101 depicted in FIG. 7, the air current guide 102 depicted in FIG. 8, or the air current guide 101Z depicted in FIG. 9) is provided at the non-heating position on the endless film to circulate the air current. Thus, the air current performs heat exchange at the non-heating position on the endless film to exhaust heat. Accordingly, the non-heating position on the endless film is not overheated.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device, comprising:

a rotatable endless film to heat a sheet;

a heat source contacted and surrounded by the endless film to heat the endless film;

a pressing member disposed opposite the heat source; and an air current generator to generate an air current inside a loop formed by the endless film, the endless film and the pressing member disposed to sandwich and feed the sheet forward as the sheet passes therebetween, the air current generator directing the air current on the endless film at a given position where the endless film heated by the heat source heats the sheet, wherein the air current generator changes one of an amount and a speed of the air current according to a width of the sheet parallel to a width direction of the endless film.

2. The fixing device according to claim 1, wherein the air current generator is provided at least at one end of the endless film in a width direction of the endless film perpendicular to a direction of rotation of the endless film.

3. The fixing device according to claim 2, wherein the air current generator comprises a fan.

4. The fixing device according to claim 1, wherein the air current generator generates an air current channel from one end to another end of the endless film in a width direction of the endless film perpendicular to a direction of rotation of the endless film.

5. The fixing device according to claim 1, further comprising:

a temperature detector to detect temperature of one of the endless film and the air current generated by the air current generator, wherein the air current generator changes one of an amount and a speed of the air current according to the temperature detected by the temperature detector.

6. The fixing device according to claim 5, wherein the temperature detector detects the temperature of one of the endless film and the air current generated by the air current generator at a plurality of positions on the endless film and in the air current generated by the air current generator.

7. An image forming apparatus, comprising:

the fixing device according to claim 1.

8. The image forming apparatus according to claim 7, wherein the air current generator is provided at two ends of the endless film in a width direction of the endless film perpendicular to a direction of rotation of the endless film.

9. The fixing device according to claim 1, wherein the air current generator is provided at two ends of the endless film in a width direction of the endless film perpendicular to a direction of rotation of the endless film.

10. A fixing device, comprising:

a rotatable endless film to heat a sheet;

a heat source contacted and surrounded by the endless film to heat the endless film;

a pressing member disposed opposite the heat source;

an air current generator to generate an air current inside a loop formed by the endless film, the endless film and the pressing member disposed to sandwich and feed the sheet forward as the sheet passes therebetween; and an air current guide provided inside the loop formed by the endless film to circulate the air current generated by the air current generator in a width direction of the endless film perpendicular to a direction of rotation of the endless film.

11. The fixing device according to claim 10, wherein the air current guide is provided only at a region on the endless film in the width direction of the endless film over which the sheet does not move on the endless film.

12. The fixing device according to claim 11, wherein the air current guide forms an air duct.

13. The fixing device according to claim 10, wherein the air current guide forms an air duct.

14. A fixing device, comprising:

a rotatable endless film to heat a sheet;

a heat source contacted and surrounded by the endless film to heat the endless film;

a pressing member disposed opposite the heat source;

an air current generator to generate an air current inside a loop formed by the endless film, the endless film and the pressing member disposed to sandwich and feed the sheet forward as the sheet passes therebetween; and an air current guide provided inside the loop formed by the endless film to circulate the air current generated by the air current generator in a width direction of the endless film perpendicular to a direction of rotation of the endless film, wherein the air current guide extends from the air current generator provided at least at one end of the endless film to a center of the endless film in the width direction of the endless film inside the loop formed by the endless film and is bent back toward the air current generator to form a heat exchange channel to exhaust the air current from the at least one end of the endless film to an outside of the endless film.

15. The fixing device according to claim 14, wherein the air current guide is bendable at different positions in the width direction of the endless film.

16. The fixing device according to claim 14, wherein the heat exchange channel is provided only at a region on the endless film in the width direction of the endless film over which the sheet does not move on the endless film.

* * * * *